United States Patent [19]

Bowen

[11] Patent Number: 4,971,235

[45] Date of Patent: Nov. 20, 1990

[54] CURTAIN THREADER FOR A CURTAIN ROD HAVING OPEN ROUGH ENDS

[76] Inventor: Imogene Bowen, 675 Kingsford Rd., Columbus, Ohio 43204

[21] Appl. No.: 321,215

[22] Filed: Mar. 9, 1989

[51] Int. Cl.[5] ..... A47H 3/00

[52] U.S. Cl. ..... 223/105

[58] Field of Search ..... 223/105; 29/241

[56] References Cited

U.S. PATENT DOCUMENTS

| | | | |
|---|---|---|---|
| 1,810,207 | 5/1931 | Hart | 223/105 |
| 1,887,110 | 11/1932 | Yuengel | 223/105 |
| 1,930,996 | 10/1933 | Cuthbert | 223/105 |
| 2,024,694 | 12/1935 | Koehler | 223/105 |
| 2,183,328 | 12/1939 | Baacke | 223/105 |
| 2,378,970 | 5/1945 | Baumann | 223/105 |
| 2,541,293 | 2/1951 | Robison | 223/105 |
| 2,684,795 | 7/1954 | Gore | 223/105 |

*Primary Examiner*—Werner H. Schroeder

*Attorney, Agent, or Firm*—Anthony D. Cennamo

[57] ABSTRACT

A threader for curtain rod of the telescoping type having open ends of rough cut metal, to easily thread the curtain rod through the hem of the curtain. The structure has an insertible end of the spring resilient material to be inserted in the rod opening and a spring transversely crossing the insertible end. The spring is of a greater diameter than that of the crossection of the standard type of rod. To facilitate the threading of the threader into the end of the curtain rod the crossectional spring is compressed. Accordingly, the threader is readily adaptable to curtain rods of varying crossectional diameters.

1 Claim, 1 Drawing Sheet

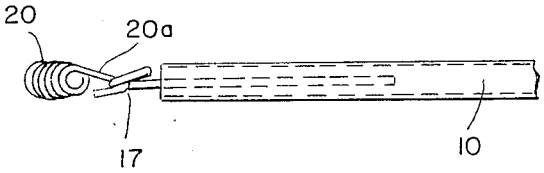
FIG. 2
FIG. 1
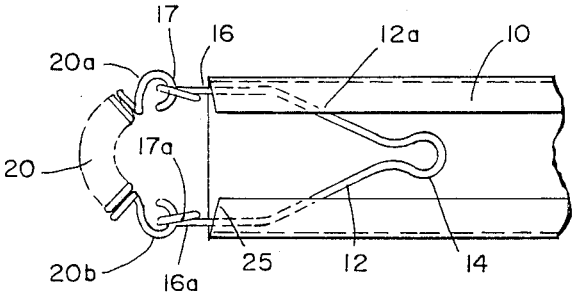

CURTAIN THREADER FOR A CURTAIN ROD HAVING OPEN ROUGH ENDS

BACKGROUND

The commercial type of curtains and liners for drapes are of a net, mesh, or other loosely woven fabrics. The standard curtain rod for this type of curtain is generally telescoping for adaptation to varying sizes of windows. The construction of the curtain rod is not one of precision, and since they are telescoping, the curtain rod ends preclude structure over their ends. Accordingly, it has been troublesome to thread the curtain rod through the hem of the curtain. The sharp end of the rod would snag or catch to the curtain hem. This damages the curtain and is most agravating and frustrating to the user.

There are several prior art known schemes for assisting in the threading of the rod through the curtain. Unfortunately, the product of these schemes are more troublesome than the problems they seek to alleviate. Further, the prior art devices are cumbersome and expensive to manufacture.

SUMMARY OF THE INVENTION

The present invention in its preferred constructed embodiment comprises structure for threading a typical telescoping sharp ended curtain rod through a curtain hem without snaging or catching the hem. The threader comprises an insertible end that is closed and rounded for ease of insertion in the curtain. Extending from the extreme portion of the rounded end is a spring-like heavy wire protruding outwardly to a crossection greater than the crossection of the curtain rod. Attached to the end of the extended wire is a spring fastened at its two ends to the protruding wire. The spring has a length greater than that of the crossection of the most common type of commercial curtain rods.

OBJECTS OF THE INVENTION

It is a principal object of the present invention to provide a threader for assisting in threading a rough cut open-ended telescoping curtain rod through the hem of a loosely woven fabric.

It is another object of the present invention to provide such a threader that is adaptable to any size of the commonly available curtain rods of the aforesaid type.

A further object of the present invention is to provide a threader for threading a rough cut curtain rod through a loosely woven fabric that is made of synthetic material and a single piece structure.

Another object of the present invention is to provide an assist for threading a curtain rod through a curtain of loosely woven fabric, that is simple in construction and easily adaptable to the task.

Other objects and features of the present invention will become apparent from the following detailed description when taken in conjunction with the drawings in which:

BRIEF DESCRIPTION OF THE DRAWINGS

FIG. 1 is a frontal view of the embodiment of the present invention in its most preferred constructed embodiment.

FIG. 2 is a side view of the embodiment of the present invention illustrated in FIG. 1 and wherein the embodiment is shown in a work function and environment.

DETAILED DESCRIPTION OF THE INVENTION

With particular reference to the drawings, there is illustrated in FIG. 1 a frontal view and in FIG. 2 a side view of the frontal view, of the present invention in its most preferred embodiment.

The curtain rod 10 is a conventional type of structure commercially available. This type of curtain rod is generally in two sections, one telescoping within the other. In this way, the curtain rod can be adapted to a range of sizes of windows, doors, and the like. In order that the slideable feature be retained and also for mass production, there is no additional structure adapted to the ends of the rods furthermore, this type of curtain rod to retain its low cost is not machined on the extreme ends after cut to size on the form making machine. As a result, the ends are relatively sharp, jagged, and rough. This is in turn, lends to the problem encountered in every household, that of stringing threading a fine netting material with a rough-end curtain rod.

Curtain rod 10 comprises an elongated member having the longitudinal edges bent inwardly into a pair of U-channels. The curtain rod generally of two sections, has one end of the rods of slightly less crossectional diameter than the other curtain rod to permit one rod to slide into the other. Again, as aforesaid, the edges 25 are rough and would damage delicate material and would snag the material irrespective of the density of the material of the curtain and the curtain hem.

The curtain rod 10 comprises a pair of open ends created by the severing of the pair of U-channels. The threader of the present invention comprises a spring resilient wire or the like material having a pair of parallel arms 16 and **16*a* that extend from the pair of open-ended loops 17. The parallel arms 16 and 16*a* are approxmately one third/one half of the overall length of the threader. Thereafter, the parallel arms extend into descending arms 12 and 12*a* that descend inwardly toward a mid-point. At the mid-point, the pair of descending arms 12 and 12*a***, form a closed-loop.

The spring resilient material of the loop 14 permits the parallel arms 16 and the descending arms 12, to be compressed for ease of insertion in the end of the curtain rod 10.

Connected to the two loops 17, having second loops **20*a* and 20*b* extending from one to the other, is a continuous spring 20. When the spring 20** is not compressed the natural tendency is to spring outwardly. In turn, the compression for the insertion of the threader into the hem of the curtain is just sufficient without stress.

The loops **20*a* and 20*b* extend slightly greater than the crossectional diameter of the curtain rod 10. When the threader is forced into the hem of the curtain, the loops 20*a* and 20*b*** prevent the spring from being pushed into the curtain rod.

The bowed portion of the spring 20 when taken into consideration with the rounded diagaonal direction, assist the rod to be guided into the hem of the curtain without the inconvenience of the rough edged curtain rod damaging the hem of the curtain.

The spring 20 material, in a practical embodiment, comprises a heavy gauge wire having a smooth non-corrosive and non-rusting surface.

The spring 20 forces the parallel arms 16 and **16*a* to swing outwardly and make contact with the inside wall of the U-channels of the curtain rod 10. However, for removal of the threader from the curtain rod 10, the spring 20 is again compressed, relieving the tension on the parallel arms 16 and 16***a*, to permit ease of withdrawal.

Although certain and specific embodiments have been illustrated and described, it is understood that modifications and departures may be had without departing from the spirit and scope of the invention.

I claim:

1. A threader for ease of insertion of a curtain rod into the hem of a curtain, wherein the curtain rod is a pair of elongated rods each having its longitudinal edges folded inwardly into a pair of U-channels and slideable one into the other and wherein the ends of said rod are rough cut edges; comprising:

a spring resilient material with a smooth heavy gauge wire formed into a pair of loops at its extremeties, said material extending longitudinally from said pair of loops into parallel paths, said parallel paths having a distance therebetween greater than that of the inside diameter of said U-channels and descending downwardly into a closed loop at a distance to the crossectional midpoint to the longitudinal length of said curtain rod;

a coil spring having an overall length greater than the crossectional diameter of said curtain rod, including a pair of loops at either end, said pair of loops adapted to interconnect with said loops on said wire material, said parallel paths and said spring adapted to be compressed and inserted in said curtain rod, whereby said parallel paths abut the inner walls of said U-channels, and wherein:

said loops on said spring extend in distance beyond the diameter of the curtain rod and thereby prohibits further insertion of the threader into the rod.

* * * * *